US006565157B2

(12) United States Patent
Barile, Jr. et al.

(10) Patent No.: US 6,565,157 B2
(45) Date of Patent: May 20, 2003

(54) MOLDED FOAM SPRING SEAT

(75) Inventors: Peter W. Barile, Jr., Morristown, TN (US); Peter Barile, Sr., Morristown, TN (US)

(73) Assignee: Shelby Williams Industries, Inc., Morristown, TN (US)

( * ) Notice: Subject to any disclaimer, the term of this patent is extended or adjusted under 35 U.S.C. 154(b) by 12 days.

(21) Appl. No.: 09/792,365

(22) Filed: Feb. 23, 2001

(65) Prior Publication Data

US 2002/0117885 A1 Aug. 29, 2002

(51) Int. Cl.[7] ..... A47C 7/02

(52) U.S. Cl. ..... 297/452.52; 297/452.53; 297/452.22; 297/440.22

(58) Field of Search ..... 297/452.52, 452.53, 297/452.54, 452.49, 446.1, 446.2, 440.22, 452.22, 452.26, 452.27, 452.35, 452.37

(56) References Cited

U.S. PATENT DOCUMENTS 2,663,359 A * 12/1953 Wood ..... 297/253
3,455,605 A * 7/1969 Anderson ..... 297/446.2
3,586,375 A * 6/1971 Rathbun ..... 297/452
3,656,807 A * 4/1972 Arida et al. ..... 297/452
4,415,147 A 11/1983 Biscoe
5,538,325 A * 7/1996 Bullard ..... 297/440.22
6,116,694 A * 9/2000 Bullard ..... 297/452.52

* cited by examiner

*Primary Examiner*—Anthony D. Barfield
*Assistant Examiner*—Stephanie Harris
(74) *Attorney, Agent, or Firm*—Polster, Lieder, Woddruff & Lucchesi, L.C.

(57) ABSTRACT

A molded foam spring seat includes a seat cushion having a bottom surface supported by a support frame having an opening therein. A drop-in frame is insertable within the opening, with the drop-in frame including a pair of opposed walls having fastening means thereon. A plurality of compression springs are each detachably extended between the fastening means on the drop-in frame. Each compression spring is in partial compression until compressed downward by a user seated on the seat cushion. Each compression spring resiliently rebounds to partial compression when the seat cushion is not compressed. The seat cushion includes sides tapered inwardly toward a seat cushion upper surface to reduce bulging of each side outwards with repetitive use of the seat cushion, and to minimize wear on the seat cushion sides when other seat cushions and support frames are positioned adjacent, or are stacked on the seat cushion.

26 Claims, 6 Drawing Sheets

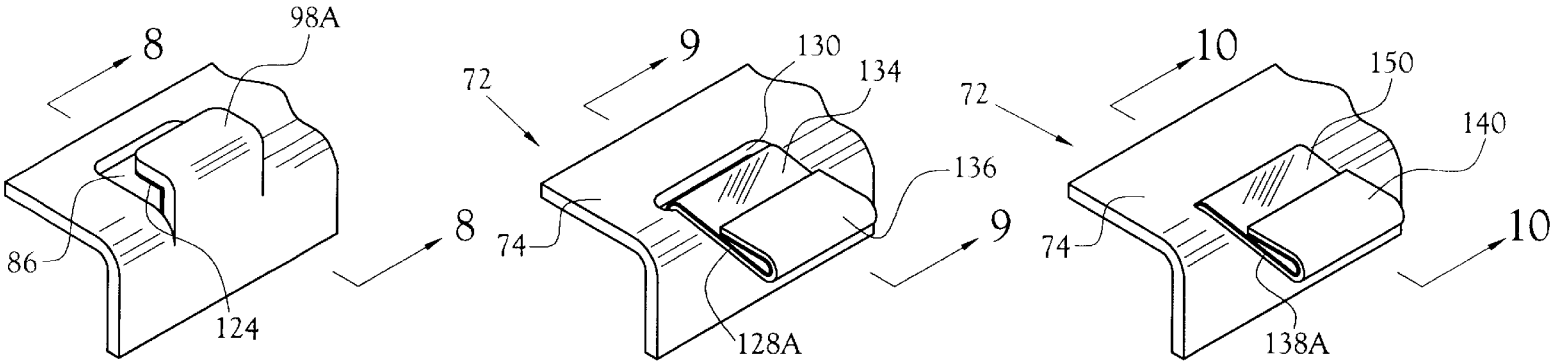
Fig.7
Fig.6
Fig.5
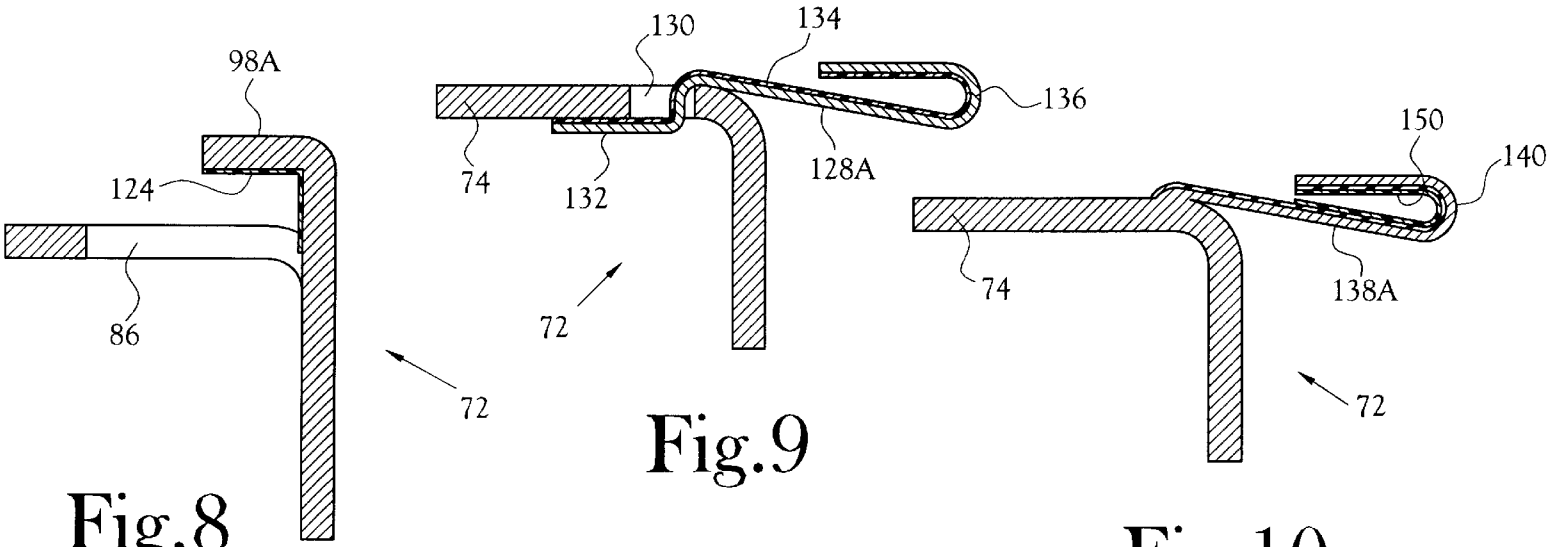
Fig.10
Fig.9
Fig.8

MOLDED FOAM SPRING SEAT

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF INVENTION

1. Field of Invention

This invention relates generally to the field of seating, and more particularly to chair seats that are composed of molded foam supported by resilient springs.

2. Description of the Related Art

Prior chair seats have included a foam padded seat cushion and a plurality of metal springs attached to a wooden frame positioned under the foam padded seat cushion for support of a user's weight when seated on the chair seat. With repetitive use, the prior chair seats have experienced significant flattening of the foam padded seat cushion portion with resulting bulging outwards of the side portions of the foam padding. With sideways bulging of the foam padding, the opportunity for wear increases for the upholstery fabric covering the foam padding when the seat cushion is stacked upon, or ganged beside, other chairs having similar configurations. In addition, the metal springs of prior seat cushions have imposed strain on the wooden frame enclosing the metal springs, with resulting failure of the wooden frame and/or connectors between the metal springs and the wooden frame with repetitive use, thereby reducing the useful life of the chair seat.

It is therefore an object of the present invention to provide a spring seat which includes a seat cushion positioned on a frame having a plurality of compression springs providing support for the foam seat cushion.

It is a further object of the present invention to provide a spring seat which includes a molded foam seat cushion positioned on a support frame having a plurality of compression springs suspended between a metal frame within the support frame, with the support frame supporting the seat cushion.

It is a further object of the present invention to provide a spring seat which includes a molded foam seat cushion positionable above a frame having a plurality of compression springs supporting the seat cushion, with the frame and seat cushion supported by a chair support frame in a configuration that protects the sides of the molded foam seat cushion from wear during stacking of the chair support frame.

BRIEF SUMMARY OF INVENTION

In accordance with the present invention there is provided a molded foam spring seat for support of a seated user. The spring seat includes a seat cushion of molded foam composition having an upper surface and a bottom surface with a recess positioned therein. The seat cushion is supported by a support frame defining an opening therein. A drop-in frame is insertable within the opening of the support frame. The drop-in frame includes a plurality of side walls defining an interior opening, with at least one opposed pair of side walls of the drop-in frame having fastening means thereon. A plurality of compression springs span the drop-in frame interior opening, with the opposed ends of each compression spring attachable to the fastening means on the opposed pair of side walls of the drop-in frame. Each compression spring is detachably extended in partial compression between the fastening means positioned on the opposed pair of side walls. The compression springs are compressed downward in support of the seat cushion bottom surface by a seated user. Each compression spring resiliently rebounds to partial compression in support of the seat cushion when not in use, thereby providing a resilient seat cushion with an extended useful life. The molded foam seat cushion further includes sides having tapered surfaces that are inwardly tapered toward the seat cushion upper surface. The tapered surfaces of the sides reduce outwards bulging of the sides with repetitive use of the seat cushion, and minimizes wear on the sides of the seat cushion when similar seat cushions and support frames having like configurations are positioned adjacent during side-by-side positioning, or are stacked thereon.

BRIEF DESCRIPTION OF THE FIGURES

FIG. 5 is a perspective view of one embodiment of a flanged wall of a drop-in frame having fastening means extended from the frame;

FIG. 6 is a perspective view of an alternative embodiment of a flanged wall of a drop-in frame having a connector inserted into a slot within the flanged wall;

FIG. 7 is a perspective view of an alternative embodiment of a flanged wall of a drop-in frame having a connector bonded onto the flanged wall;

FIG. 8 is a section view along 8—8 of FIG. 5;

FIG. 9 is a section view along 9—9 of FIG. 6;

FIG. 10 is a section view along 10—10 of FIG. 7;

DETAILED DESCRIPTION OF INVENTION

Figure 1:
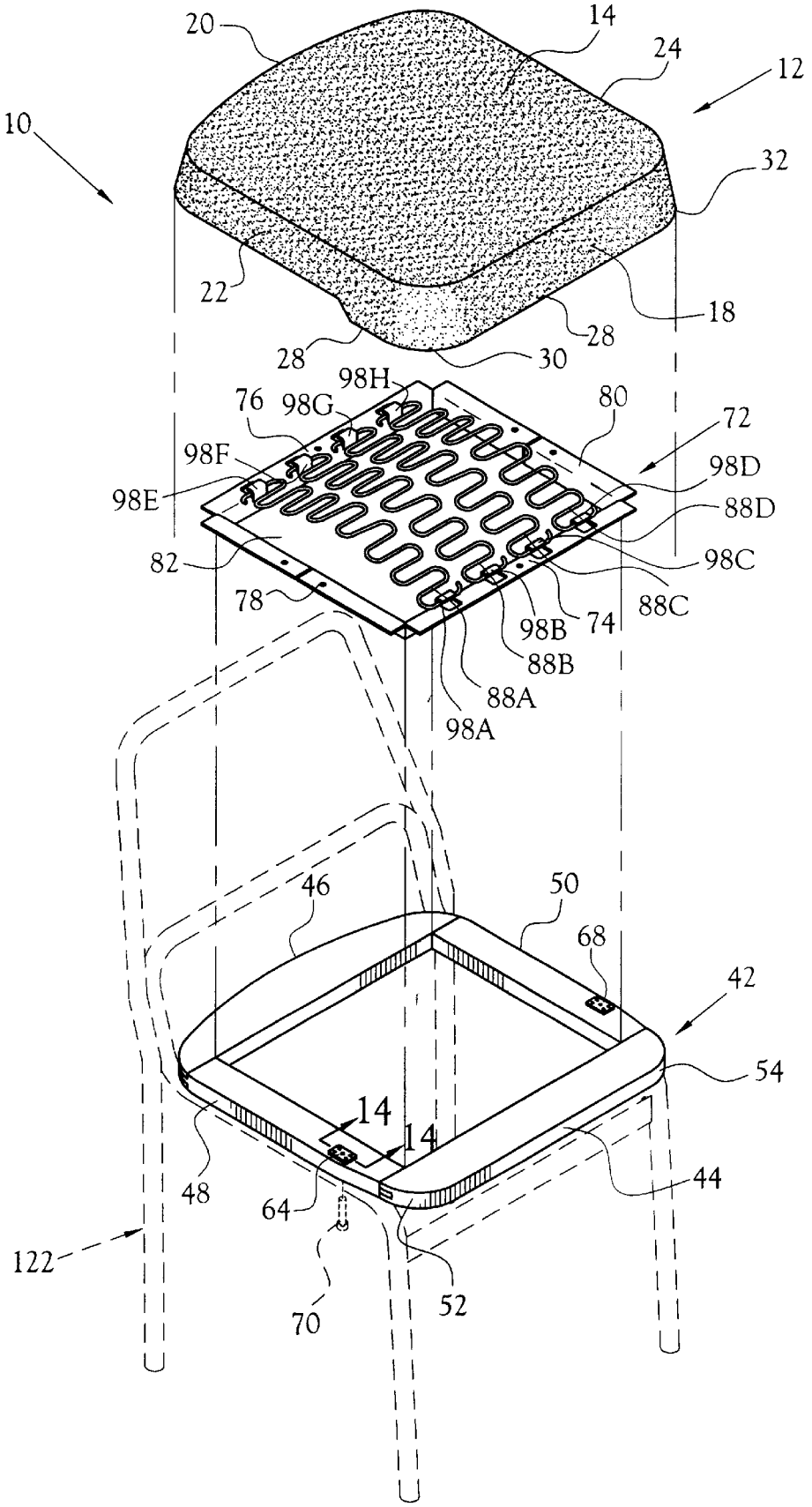
FIG. 1 is an exploded perspective view of one embodiment of a molded foam spring seat embodying various features of the present invention.

Referring initially to FIG. 1, one embodiment of a molded foam spring seat 10 for support of a seated user (not shown) includes a seat cushion 12 composed of a molded foam material known to those skilled in the art. One embodiment of the molded foam spring seat 10 depicted in FIGS. 1 and 2 includes a support frame 42 positionable underneath the seat cushion 12, and a drop-in frame 72 that is inserted underneath seat cushion 12 and within the support frame 42. The assembled unit of the seat cushion 12, drop-in frame 72, and support frame 42 (see FIG. 3) is attachable to a chair frame 122 for support of the molded foam spring seat 10 above a supporting surface (see FIG. 1). A chair frame 122 having the molded foam spring seat 10 attached thereon is stackable with other chair frames (not shown) of like design, or is ganged side-by-side (not shown) with other chair frames of like design.

The seat cushion 12 includes a top surface 14 having a length and a width of about equal dimensions. The molded foam material of the seat cushion 12 includes a central crown 15 molded in the top surface 14 (see FIG. 4). The raised portion of the central crown 15 stretches an upholstery fabric cover (not shown) that is utilized to cover the top surface 14 and each side surface of the seat cushion 12. The central crown 15 reduces wrinkling of the fabric cover when the fabric cover is stretched due to wear by the repetitive seating of respective users on the fabric covering the top surface 14 of the seat cushion 12. The upholstery fabric cover may include a perimeter seam that is attached along the bottom surface 16 of the seat cushion or, alternatively, is attached along the perimeter seam to the sides of the support frame 42.

Figure 2:
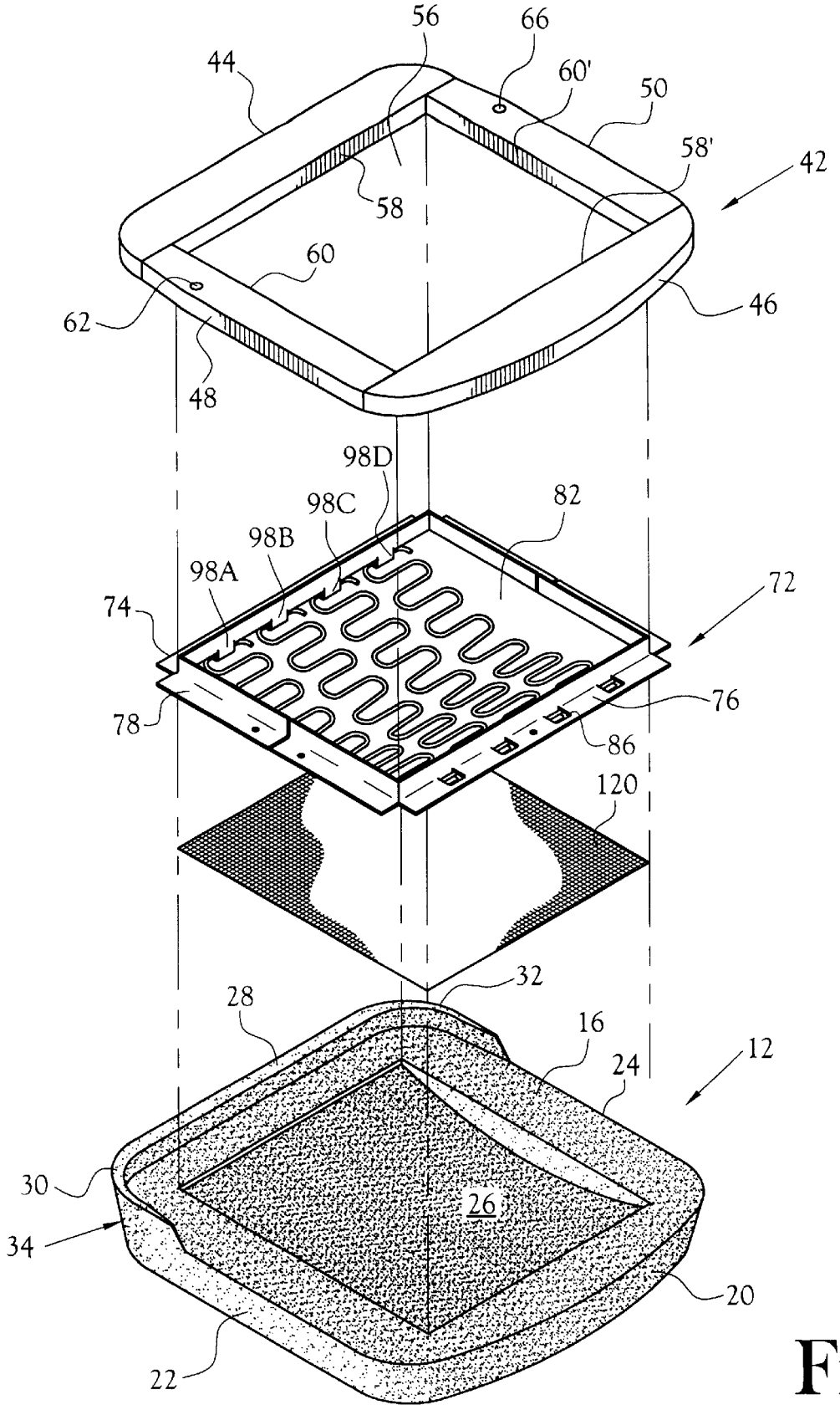
FIG. 2 is an exploded bottom perspective view of one embodiment of the molded foam spring seat depicted in FIG. 1.

The seat cushion 12 includes a bottom surface 16 having a recess 26 positioned centrally within the bottom surface 16. As depicted in FIG. 2, the recess 26 forms a generally rectangular opening that is centered within the bottom surface 16, and is curved upwards from the bottom surface 16 toward the top surface 14 to form an arched recess 26. A front side 18 is generally planar along a width dimension of the front of the seat cushion 12. The front side 18 is bounded by a curved first side front corner 30 and a curved second side front corner 32. The front side 18, the first side front corner 30, and the second side front corner 32 are formed with a taper 34 that is angled inwards toward the top surface 14. One embodiment of the seat cushion 12 includes a taper 34 of an angle between about 4 degrees draft to about 5 degrees draft from a vertical plane 36 (see FIG. 4). Alternative angles for the taper 34 may be utilized for the front side 18 and side front corners 30, 32. The taper 34 of the front side portions provide for a reduction of the sideways extension and lateral sagging of the foam cushion materials, and related sagging of stretched upholstery fabric thereon, due to foam compression and fabric wear from repetitive seating of users on the top surface 14 and against the front side 18 and side front corners 30, 32.

Figure 3:
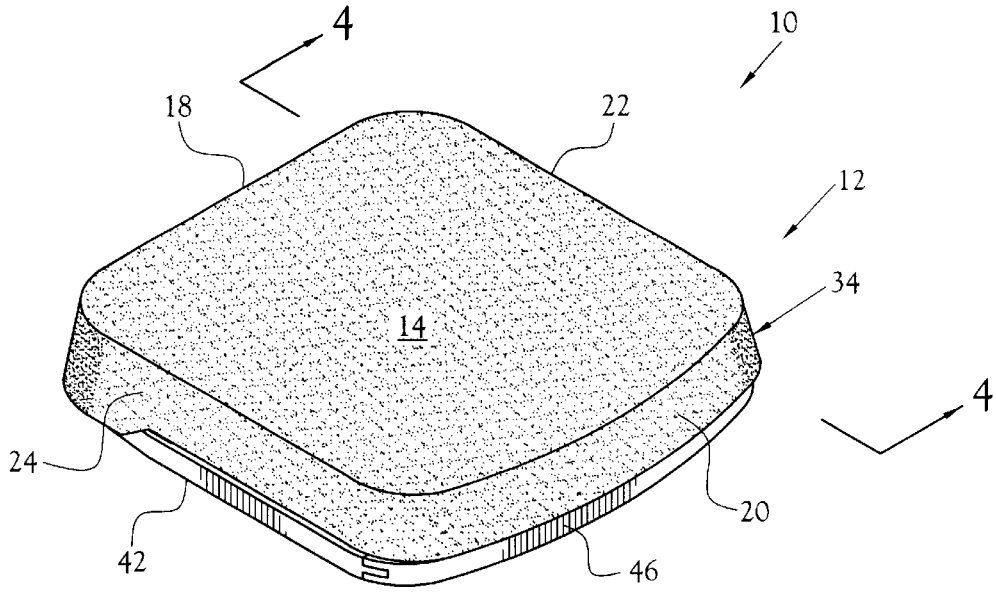
FIG. 3 is a perspective rear view of an assembled spring seat of FIG. 1.

A back side 20 of the seat cushion 12 is curved outwards along the width dimension of the rear of the seat cushion 12 (see FIG. 2 and 3). The outwardly curved portion of the back side 20 extends backwards between a pair of generally upright back supports of the typical chair frame 122 as illustrated in phantom in FIG. 1. The seat cushion 12 further includes a first side 22 and a second side 24, that are substantially planar along the length dimension of each side 22, 24. As provided for the front of the seat cushion 12, the back side 20, first side 22 and second side 24 of the seat cushion 12 includes a taper 34 of an angle of between about 4 degrees draft to about 5 degrees draft from a vertical plane 36 (see FIG. 4). The taper 34 of each side provides the top surface 14 with a surface area smaller than the surface area of the bottom surface 16. The taper 34 for each side 18, 20, 22, 24 provides sloped side surfaces that reduce the sideways extension and lateral sagging of the foam cushion materials, and related sagging of stretched upholstery fabric thereon, due to foam compression and fabric wear from repetitive seating of users on the top surface 14 of the seat cushion 12. The taper 34 further provides protection of the sides of the foam cushion materials and related stretched upholstery fabric from being pinched against and worn by chair frames 122 that may be repetitively stacked on top of, or underneath the seat cushion 12.

The seat cushion 12 includes a cushion overlap 28 extended along the front side 18 between side front corners 30, 32. When a generally rigid support frame 42 is positioned under seat cushion 12, the cushion overlap 28 extends downward and covers the front member 44 of support frame 42, and covers a front portion along a first side member 48 and a second side member 50 of the support frame 42. Therefore, a first front corner 52 and a second front corner 54 of the support frame 42 are protected by the cushion overlap 28 for a length along each side member of about three inches to about four inches from the front corners 52, 54.

The cushion overlap 28 provides a foam surface for support of upholstery materials such as fabric material stretched across the seat cushion front side 18, to reduce the shifting of the fabric along the front side 18 during repetitive lateral movements by a seated user. The cushion overlap 28 further reduces the opportunity for rubbing of the fabric material against the potentially abrasive rigid surface of the front member 44 of support frame 42 during vertical shifting movements by a seated user on the seat cushion 12. In addition, when the seat cushion 12 and support frame 42 are attached to a chair frame 122 that is stacked on chair frames of similar configuration, the cushion overlap 28 provides a front spacer of molded foam to minimize the pinching and cutting of fabric material between stacked seat cushions. The cushion overlap 28 also provides a front foam support panel that maintains an aesthetically pleasing, unwrinkled finish for the fabric material stretched across the front side 18 of the seat cushion 12.

The overall length and width of the seat cushion 12 includes a width of about twelve inches to about eighteen inches, and a length of about twelve inches to about eighteen inches. The height of the molded foam material of the seat cushion 12 is about three inches of height at the cushion overlap 28 and front side 18 of the seat cushion 12, and about two inches of height at the back side of the seat cushion 12. Alternative embodiments of the seat cushion 12 can include variable shapes and smaller or larger dimensions to appropriately fit a stackable chair frame 122 of similar configuration known to those skilled in the art.

The support frame 42 is detachably positionable against the bottom surface 16 of the seat cushion 12. The support frame 42 is a substantially rigid frame having four sides with an interior opening 56 therein. The four sides include the front member 44, a back member 46, a first side member 48, and a second side member 50, each of which are preferably composed of wood, or alternatively of metal or another material known to those skilled in the art of manufacturing portable, stackable chairs. The front member 44 includes the first front corner 52 that is positioned underneath the first side front corner 30 of seat cushion 12, and includes the second front corner 54 that is positioned underneath the second side front corner 32 of seat cushion 12.

Figure 4:
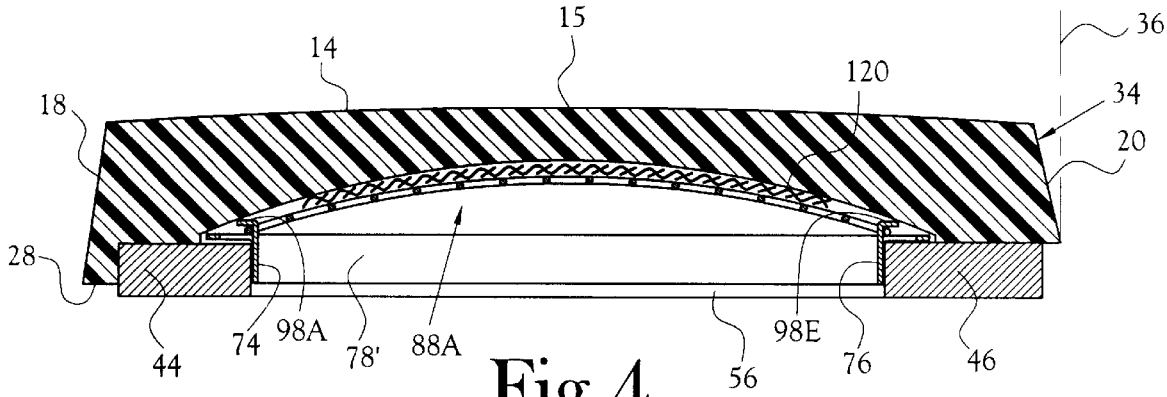
FIG. 4 is a section view along 4—4 of FIG. 3, depicting a compression spring in partial compression in an arc within a bottom surface recess of the seat cushion.
Figure 11:
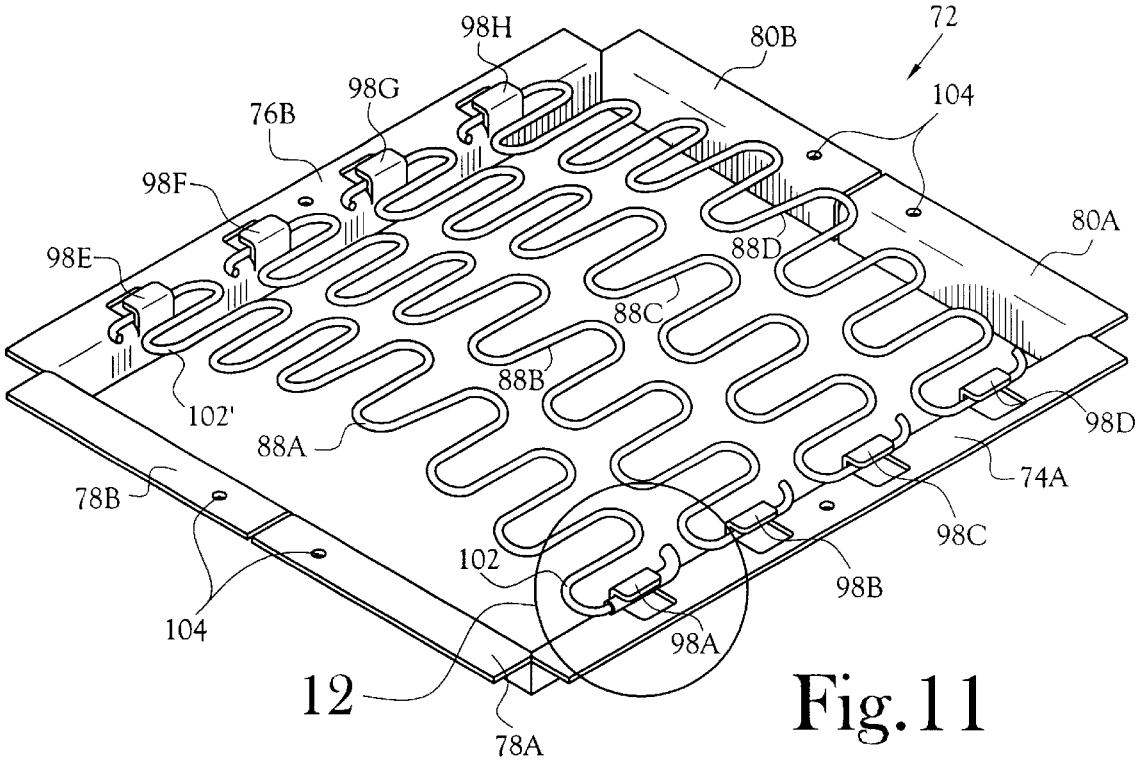
FIG. 11 is a perspective view depicting one embodiment of the frame having compression springs in partial compression between fastening means on the frame.
Figure 12:
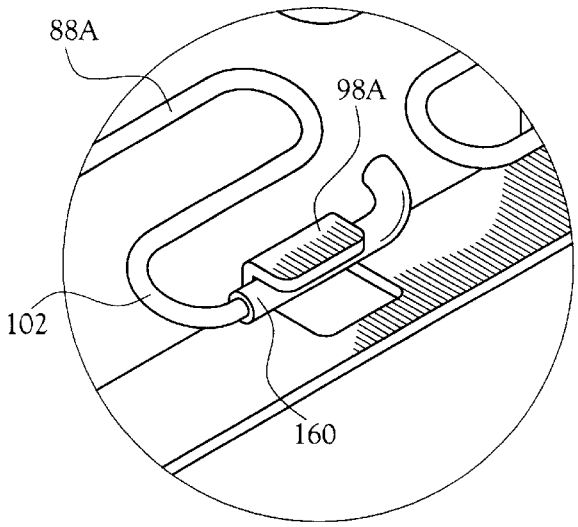
FIG. 12 is a detail view of FIG. 11, depicting an end of one compression spring detachably attached to the fastening means of the frame.
Figure 14:
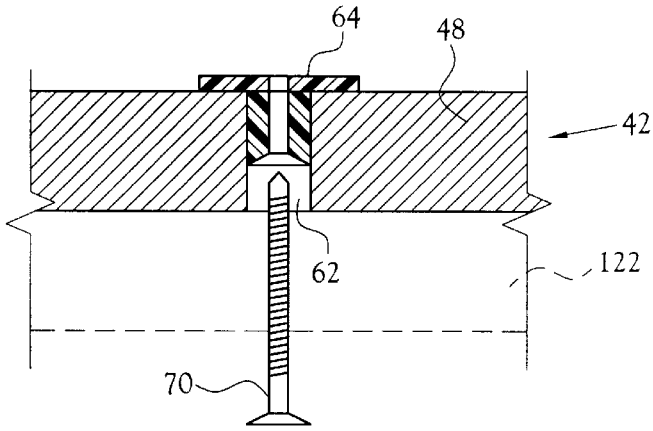
FIG. 14 is partial side sectional view, in section along 14—14 of FIG. 1, illustrating a connector inserted in a side wall of a side member of the invention.

The interior opening 56 of frame 42 includes interior sides having a front 58 and back 58', a first side 60, and a second side 60' (see FIG. 2), within which the drop-in frame 72 is insertable to provide additional structural support for the support frame 42 (see FIG. 4). The drop-in frame 72 is configured as a frame having two like configured portions, as depicted in FIGS. 1, 2 and 11. An alternative embodiment for the drop-in frame 72 includes a frame configured as a rectangular frame having continuous sides (see side 72' in FIG. 4). When drop-in frame 72 is inserted within the interior opening 56, and frame 42 is attached against the bottom surface 16 of seat cushion 12 (see FIGS. 1–3), the front member 44 of frame 42 is positioned to be enclosed by cushion overlap 28 of the seat cushion 12, and the back member 46 of frame 42 is aligned under the back side 20 of the seat cushion 12. The assembled molded foam spring seat 10 is attachable to a chair frame 122 having a pair of horizontally opposed side frames, as depicted in phantom in FIG. 1. A preferred connector may include connector screws 70, bolts or similar connectors, for insertion of a screw into connector hole 62 having a T-nut 64 therein, in first side member 48 (see FIGS. 1 and 14). A second screw is inserted into connector hole 66 having a T-nut 68 therein, in second side member 50. Each T-nut 64, 68 provides a fixture that accepts the inserted screw for tight binding of the screw or bolt within each respective hole 62, 66 within the wood or metal of the frame 42.

One embodiment of the drop-in frame 72 includes two pairs of opposed side walls, with each side wall being segmented at about a mid-section, and each side wall having a top flanged surface extended horizontally outwards from an integrally attached and generally vertical side wall surface. The four side walls form a substantially rigid rectangular frame when assembled and connected to the support frame 42. The assembled drop-in frame 72 includes a front wall 74, a rear wall 76, a first side wall 78 formed by aligned side wall segments 78A and 78B (see FIG. 11), and a second side wall 80 formed by aligned side wall segments 80A and 80B (see FIG. 11), which enclose and define a central opening 82 of the drop-in frame 72 (see FIG. 2). The length dimension of front wall 74 and rear wall 76 is preferably longer than the length of first side wall 78 and second side wall 80, thereby providing an adequate length across the central opening 82 for a plurality of compression springs to be aligned side-by-side and in parallel orientation.

One embodiment of compression springs includes a plurality of sinuous shaped springs 84 that are extended across the central opening 82 from the front to the rear of the drop-in frame 72. Each one of the sinuous shaped springs 84 include opposed spring ends 102, 102' that are respectively connected to a plurality of fastening means attached proximate and in spaced apart alignment along the front wall 74 and the rear wall 76. Alternatively, the plurality of sinuous shaped springs 84 are extended between the first side wall 78 and the second side wall 80 (not shown). The plurality of sinuous shaped springs 84 provide support for the recess 26 and bottom surface 16 to prevent the molded foam seat cushion 12 from flattening into the interior opening 56 of support frame 42 when a user is seated on the top surface 14 of the seat cushion 12.

As depicted in FIG. 11, a preferred embodiment for the drop-in frame 72 includes two rigid segments of a similar "U"-shaped configuration. A front wall 74A includes a first side portion 78A and a second side portion 80A. A rear wall 76B includes a first side portion 78B and a second side portion 80B that are aligned with the respective side portions 78A and 80A to provide a segmented drop-in frame 72 that is attachable to the support frame 42 by connectors inserted through holes 104 in each respective side portion of the drop-in frame 72. After attachment of the segmented drop-in frame 72 to support frame 42, each sinuous shaped spring 88A, 88B, 88C, 88D is extended from the front wall 74A to the rear wall 76B by connecting an end of each spring to respective connectors positioned on the front wall 74A and rear wall 76B (see FIG. 11).

One embodiment of the plurality of sinuous shaped springs 84 includes a first spring 88A (see FIGS. 1 and 4) having opposed spring ends 102, 102' that are each detachably connectable to respective fastening means 98A, 98E formed integrally on the respective front wall 74A and rear wall 76B. Fastening means includes connectors 98A 98H (see FIGS. 1, 4, 5, 8, 11 and 12) that are raised above each respective portion of front wall 74A and rear wall 76B of the drop-in frame 72. Connectors are configured as a "C" clasp or a upwardly curved protrusion. Alternatively, another similarly configured connector is utilized as known to those skilled in the art, such as a hook that is stamped from the flanged upper portion of front wall 74A and rear wall 76B during the production of the drop-in frame 72. Having integrally formed connectors that are stamped from the flanged upper portion of at least two opposed walls of the drop-in frame 72 allows for efficient use of materials to produce each drop-in frame 72 with a minimum of connectors for connection of the plurality of sinuous shaped springs 84 to span the drop-in frame 72.

Figure 13:
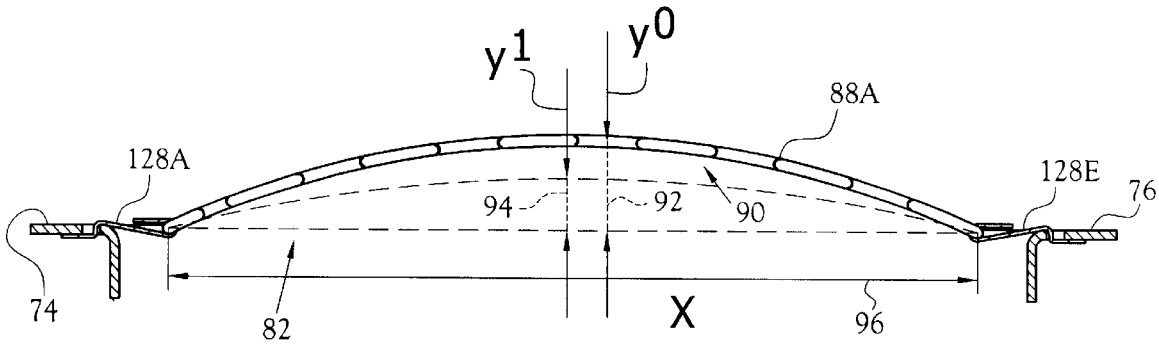
FIG. 13 is a side view of a compression spring in partial compression.

A second spring 88B, a third spring 88C, and a fourth spring 88D are aligned in side-by-side configuration in an arch 90 (see FIG. 13) of an arcuate plane above the horizontal plane of central opening 82. Each spring 88B, 88C, 88D includes opposed spring ends 102, 102' that are removably connectable to the respective fastening means of connectors 98B–98H (see FIG. 11). As depicted in FIGS. 5 and 8, connector 98A may include a coating and/or insulator 124 within the curve of the connector 98A to which a spring end 102 of sinuous shaped spring 88A is connected. Each spring end 102, 102' of springs 84 may include a tubular insulator 160 (see FIG. 12) of plastic, vinyl, or other insulator material, to insulate spring ends 102, 102' from contact within connectors 98A–H to reduce wear between, and/or to reduce noise generated, when spring ends are pivoted within the fastening means when a user is seated on the seat cushion 12.

When detachably extended between the front wall 74A and the rear wall 76B, each sinuous shaped spring is maintained in partial compression in an unweighted configuration (see FIGS. 4 and 13), when a user is not seated on the seat cushion 12. A height 92, or $y^0$, is the height of the arch 90 of each spring in the unweighted configuration above the upper flanged surfaces of front wall 74A and rear wall 76B.

When a user is seated on the seat cushion 12, the height 94, or $y^1$, is reduced to a weighted configuration having a diminished arch for each of the sinuous shaped springs due to compression of each spring by a user seated on the foam seat cushion 12. The overall length 96, or X, of each of the sinuous shaped springs 84 remains constant due to the connecting of each opposed end 102, 102' of each spring to the respective front wall 74A and rear wall 76B of the drop-in frame 72. With the plurality of sinuous shaped springs 84 maintained in partial compression while spanning the drop-in frame 72 inserted in the support frame 42, onto which the seat cushion 12 is positioned, the molded foam spring seat 10 provides a consistently resilient seat for a user.

An alternative embodiment of the fastening means for connecting each spring end 102, 102' to the drop-in frame 72, is depicted in FIGS. 6 and 9. A connector spacer 128A includes an end 132 insertable into a slot 130 in the flanged surface 74. The connector spacer 128A is removable from slot 130 to allow disconnection of the respective spring end 102 or 102' from walls 74, 76. Separately, the open-ended clasp 136 is disconnected from connector spacer 128A to allow for removal of the respective spring end 102 or 102' from connection with walls 74, 76, and to allow for replacement of the respective sinuous shaped springs due to wear or for installation of compression springs having alternative compression capabilities. The upper surface of connector spacer 128A may include an insulating coating 134.

Another alternative embodiment of the fastening means for connecting each spring end 102, 102' to the drop-in frame 72 is depicted in FIGS. 7 and 10, in which each of a "C" shaped clamp 138A is bonded by welding or other means known to those skilled in the art, to an upper flanged surface of the wall 74, and an opposed wall 76 of the drop-in frame 72. The interior of the connecting clasp 140 may include an insulating coating 150 (see FIG. 10) that protects the respective ends 102, 102' from wear, and/or can reduce the noise created when the spring ends are pivoted within clasp 140 each time a user is seated on the seat cushion 12.

One alternative embodiment for the seat cushion 12 includes a generally rectangular insulating layer 120 of fabric, mesh, vinyl material, or other flexible material (see FIGS. 2 and 4), that is positioned between the upwardly arched plurality of sinuous shaped springs 88A, 88B, 88C, 88D and the recess 26 in the bottom surface 16 of the seat cushion 12. The insulating layer 120 provides a layer of non-metal material to cover the springs 88A, 88B, 88C, 88D to reduce noise generated by movement of the springs when compressed, and to protect the molded foam underside surface of the recess 26 from being torn or worn by the movement of the springs 88A, 88B, 88C, 88D during seating on the seat cushion 12 over the life of the molded foam spring seat 10. The insulating layer 120 is positioned as a separate layer as depicted in FIGS. 2 and 4, or alternatively, is molded or attached onto the bottom surface 16 of the recess 26 of the molded foam seat cushion 12.

Whereas the present invention is described in specific details with respect to the illustrated embodiments, it will be recognized that alternative embodiments of the disclosed apparatus may be employed without departing from the spirit and scope of the invention as set forth in the claims appended hereto.

What is claimed is:

1. A spring seat for support of a seated user comprising:

a seat cushion having an upper surface and a bottom surface, said bottom surface having a recess positioned therein, said seat cushion including a front side, a back side and first and second sides, each side having a tapered surface being inwardly tapered from said bottom surface to said upper surface of said seat cushion, said seat cushion front side having a cushion overlap extended past a lateral plane of said bottom surface, said seat cushion overlap disposed to extend from a first and a second front corner of said seat cushion;

a frame defining an opening therein, said frame disposed against said seat cushion bottom surface, said seat cushion supported by said frame, said cushion overlap extended to overlap said frame proximal said seat cushion front side and proximal to said first and second front corner of said seat cushion;

a drop-in frame insertable within said opening in said frame, said drop-in frame including walls defining a central opening therein, said walls having at least one pair of opposed walls having fastening means positioned thereon; and a plurality of compression springs spanning said central opening of said drop-in frame, each compression spring detachably extended between said fastening means positioned on said at least one pair of opposed walls of said drop-in frame, each compression spring being in partial compression proximate said recess in said bottom surface of said seat cushion;

whereby each compression spring is compressed downward within said recess when the user is seated on said seat cushion, and each compression spring rebounds to partial compression when the user is not seated on said seat cushion.

2. The spring seat of claim 1, wherein said seat cushion is composed of molded foam, said seat cushion including a central crown in said upper surface, said bottom surface recess being arched, said seat cushion further including said cushion overlap extended proximal to said first and second front corner, said cushion overlap extended a selected length along each first and second side from respective first and second front corner to overlap said frame along said seat cushion front side and proximal to said first and second front corner.

3. The spring seat of claim 2, wherein said frame including a front member, a back member, and opposed first and second side members, said front member aligned under said seat cushion front side, said front member covered by said cushion overlap, and said back member aligned under said seat cushion back side, said frame being connectable to a chair frame by a plurality of connectors insertable respectively through said first side member and said second side member, whereby said frame and said seat cushion are supported by the chair frame above a supporting surface.

4. The spring seat of claim 3, wherein said drop-in frame including a front and a rear wall, and a first and second side wall, each of said walls having a flanged upper portion oriented outwards from said central opening of said drop-in frame, whereby said flanged upper portion of each wall is adapted to be positioned respectively on said front member, back member, and first and second side members of said frame when said drop-in frame is inserted within said frame opening.

5. The spring seat of claim 4, wherein said compression springs including a plurality of sinuous shaped springs spanning said drop-in frame opening, each sinuous shaped spring oriented in parallel alignment along an arcuate plane above said central opening of said drop-in frame, each sinuous shaped spring having opposed spring ends respectively connectable between said fastening means on said opposed pair of walls of said drop-in frame, each sinuous shaped spring having an arc along said arcuate plane configured to extend within said recess in said bottom surface of said seat cushion.

6. The spring seat of claim 5, wherein said fastening means including a plurality of connectors attached in paired alignment along said flanged upper portion on each of said front wall and said rear wall of said drop-in frame, each sinuous shaped spring having opposed spring ends connectable respectively between two opposed connectors in paired alignment along said flanged upper portion of said front wall and said flanged upper portion of said rear wall, said plurality of sinuous shaped springs extended in partial compression between said front wall and said rear wall of said drop-in frame.

7. The spring seat of claim 6, wherein said drop-in frame further including said first and said second side wall being segmented, whereby each of said front wall and said rear wall each being formed in a U-shaped configuration, each of said segmented side walls aligned in opposed orientation when said drop-in frame is inserted within said opening of said frame, said front wall inserted within said frame opening along said front member of said frame, said rear wall inserted within said frame opening along said back member of said frame, said connectors positioned along said front wall and said rear wall of said drop-in frame.

8. The spring seat of claim 7, wherein said fastening means including a plurality of spaced apart connectors formed integrally in paired alignment on said front segment and said back segment of said drop-in frame, each of said sinuous shaped spring ends connectable respectively between said spaced apart connectors in paired alignment on said front wall and said rear wall of said drop-in frame.

9. The spring seat of claim 8, wherein said fastening means further including a connector spacer pivotably connectable respectively between each respective spring end and said connectors formed integrally in paired alignment on said front segment and said back segment of said drop-in frame.

10. The spring seat of claim 1, wherein said seat cushion including a spring insulator having a generally rectangular shape, said spring insulator being composed of a material including vinyl, cloth, or synthetic fabric, said spring insulator positioned between said upper surface of said plurality of compression springs and said recess in said bottom surface of said seat cushion.

11. The spring seat of claim 3, wherein said seat cushion including a cover made of a resilient material being shaped for generally continuous coverage over said upper surface, said cover having a perimeter seam attached respectively to said front member, said back member, and said opposed first and second side members of said frame positionable underneath said bottom surface of said seat cushion.

12. A molded foam spring seat for attachment to a stackable chair support frame for support of a seated user, comprising:

a seat cushion having an upper surface and a bottom surface, said bottom surface having a recess positioned therein, said seat cushion including a front side, a back side and first and second sides, said seat cushion front side having a seat cushion overlap extended past a lateral plane of said bottom surface, said seat cushion overlap disposed to extend proximal from a first and a second front corner of said seat cushion;

a support frame defining an opening therein, said bottom surface of said seat cushion supported by an upper surface of said support frame, said support frame including a front member and a front portion of each of a first and second side of said support frame, said seat cushion overlap extends over said front member and said front portion of each of said first and second sides of said support frame;

a drop-in frame insertable within said opening in said support frame, said drop-in frame including a front wall and a rear wall having a first and a second side wall attached between said front and rear walls, said drop-in frame defining a central opening therein, said front and rear walls having fastening means thereon; and a plurality of compression springs spanning said central opening of said drop-in frame, each compression spring detachably extended between said fastening means positioned on said front and rear walls of said drop-in frame, each compression spring being in partial compression proximate said recess in said bottom surface of said seat cushion;

whereby each compression spring is compressed downward within said recess when the user is seated on said seat cushion, and each compression spring rebounds to partial compression when the user is not seated on said seat cushion.

13. The molded foam spring seat of claim 12, wherein said seat cushion including a front and back side, and a first side and second side of said seat cushion, each of said sides having a tapered side being inwardly tapered from said bottom surface to said upper surface of said seat cushion.

14. The molded foam spring seat of claim 13, wherein said seat cushion is composed of a molded foam material, said seat cushion having a central crown in said upper surface, said seat cushion further including a front side, a first and second front rounded corners, and a cushion overlap extended between said first and second front rounded corners and along said front side of said seat cushion.

15. The molded foam spring seat of claim 14, wherein said drop-in frame including each of said front wall, rear wall, and side walls having a flanged upper portion, said flanged upper portion oriented outwards from said central opening of said drop-in frame, said flanged upper portion of said front wall and said rear wall having spaced apart and aligned slots therein, whereby each flanged upper portion is adapted to be positioned respectively on said front member, back member, and first and second side members of said support frame when said drop-in frame is inserted within said support frame opening.

16. The molded foam spring seat of claim 15, wherein said drop-in frame further including said first side wall and said second side wall being segmented, whereby each of said front wall and said rear wall each being formed in a U-shaped configuration, each of said segmented side walls aligned in opposed orientation when said drop-in frame is inserted within said opening of said support frame.

17. The molded foam spring seat of claim 16, wherein said compression springs further including a plurality of sinuous shaped springs aligned in parallel along an arcuate plane above said central opening of said drop-in frame, each sinuous shaped spring having opposed spring ends respectively connectable between said fastening means on said opposed pair of side walls of said plurality of side walls of said drop-in frame, each sinuous shaped spring having an arc along said arcuate plane configured to extend within said recess in said bottom surface of said seat cushion.

18. The molded foam spring seat of claim 17, wherein said fastening means including a plurality of connectors insertable respectively into said spaced apart aligned slots in said flanged upper portion of said front wall and said rear wall, each connector is pivotably attachable to respective opposed spring ends of each sinuous shaped spring, whereby each sinuous shaped spring end pivots in relation to each respective connectors to rebound to partial compression between said front wall and said rear wall of said drop-in frame when the user is not seated on said seat cushion.

19. The molded foam spring seat of claim 12, wherein said seat cushion further including a spring insulator having a generally rectangular shape, said spring insulator being composed of a material including vinyl, cloth, or synthetic fabric, said spring insulator positioned between said upper surface of each of said plurality of compression springs and said recess in said bottom surface of said seat cushion.

20. The molded foam spring seat of claim 12, including a cover made of a resilient material being shaped for generally continuous coverage of said upper surface of said seat cushion, said cover extendable over said support frame positioned against said bottom surface of said seat cushion.

21. A spring seat for support of a seated user comprising:

a seat cushion having an upper surface and a bottom surface, said bottom surface having a recess positioned therein, said seat cushion including a front side bounded by a first and a second front rounded corner, said seat cushion having a cushion overlap extended along said front side and below a lateral plane of said bottom surface, said cushion overlap is extended proximal to said first and second front rounded corners of said seat cushion;

a support frame defining an opening therein, said seat cushion supported by an upper surface of said support frame, said cushion overlap is extended to overlap said seat frame along said seat cushion front side and proximal to said first and second front rounded corners of said seat cushion;

a drop-in frame insertable within said opening in said support frame, said drop-in frame including a front wall and a rear wall, each front and rear wall having a first and a second side wall attached thereto, each respective first and second side wall aligned to define a central opening within said drop-in frame, each of said front wall and rear wall having a plurality of connectors positioned in aligned orientation thereon; and a plurality of compression springs spanning said central opening of said drop-in frame, each compression spring detachably extended between said aligned connectors positioned on each of said front wall and rear wall of said drop-in frame, each compression spring being in partial compression proximate said recess in said bottom surface of said seat cushion;

whereby each compression spring is compressed downward within said recess when the user is seated on said seat cushion, and each compression spring rebounds to partial compression when the user is not seated on said seat cushion.

22. The spring seat of claim 21, wherein said drop-in frame including said front wall and rear wall, each respective first and second side walls being aligned to form a generally rectangular orientation in said opening of said support frame, each of said front and rear walls and said side walls having a flanged upper portion oriented outwards from said central opening of said drop-in frame, whereby said flanged upper portions of each front and rear walls and said side walls are adapted to be positioned respectively on said upper surface of said support frame when said drop-in frame is inserted within said support frame opening.

23. The spring seat of claim 22, wherein said compression springs including a plurality of sinuous shaped springs spanning said drop-in frame opening, each sinuous shaped spring oriented in parallel alignment along an arcuate plane above said central opening of said drop-in frame, each sinuous shaped spring having opposed spring ends respectively connectable between said aligned connectors on said front wall and rear wall of said drop-in frame, each sinuous shaped spring having an arc along said arcuate plane configured to extend within said recess in said bottom surface of said seat cushion.

24. The spring seat of claim 23, wherein said aligned connectors are formed integrally in paired alignment on said flanged upper portion of said front wall and rear wall of said drop-in frame, each of said sinuous shaped spring ends connectable respectively between said aligned connectors on said drop-in frame.

25. The spring seat of claim 21, wherein said seat cushion Including a front and back side, and a first side and second side of said seat cushion, each of said sides having a tapered side being inwardly tapered from said bottom surface to said upper surface of said seat cushion.

26. The spring seat of claim 25, wherein said seat cushion is composed of a molded foam material, said seat cushion having a central crown in said upper surface.

* * * * *